US008485844B2

(12) United States Patent
Omae et al.

(10) Patent No.: US 8,485,844 B2
(45) Date of Patent: Jul. 16, 2013

(54) L-SHAPED CONNECTOR

(75) Inventors: Takashi Omae, Makinohara (JP); Kazuki Zaitsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/382,084

(22) PCT Filed: Sep. 15, 2010

(86) PCT No.: PCT/JP2010/065932

§ 371 (c)(1),
(2), (4) Date: Jan. 3, 2012

(87) PCT Pub. No.: WO2011/067973

PCT Pub. Date: Jun. 9, 2011

(65) Prior Publication Data

US 2012/0100753 A1 Apr. 26, 2012

(30) Foreign Application Priority Data

Dec. 3, 2009 (JP) ..... 2009-275295

(51) Int. Cl.
*H01R 13/648* (2006.01)

(52) U.S. Cl.
USPC ..... 439/559; 439/607.01; 439/607.35

(58) Field of Classification Search
USPC ..... 439/607.01, 607.35, 559, 548, 556
See application file for complete search history.

(56) References Cited

U.S. PATENT DOCUMENTS

| | | | | |
|---|---|---|---|---|
| 5,277,610 | A | 1/1994 | Krehbiel et al. | |
| 6,280,208 | B1 * | 8/2001 | Masuda et al. | 439/98 |
| 6,422,899 | B1 * | 7/2002 | Miyazaki | 439/559 |
| 6,796,838 | B2 * | 9/2004 | Yoshioka | 439/607.01 |
| 7,597,580 | B1 | 10/2009 | Advey et al. | |
| 7,828,591 | B2 * | 11/2010 | Matsuoka | 439/559 |
| 8,187,030 | B2 * | 5/2012 | Matsuoka et al. | 439/542 |
| 2004/0057187 | A1 | 3/2004 | Kuboshima et al. | |
| 2009/0137153 | A1 | 5/2009 | Yoshioka et al. | |
| 2011/0045693 | A1 * | 2/2011 | Uchida | 439/567 |
| 2011/0230086 | A1 * | 9/2011 | Fujiwara et al. | 439/559 |

FOREIGN PATENT DOCUMENTS

| | | | |
|---|---|---|---|
| EP | 1883135 | A1 | 1/2008 |
| JP | 08078098 | A | 3/1996 |
| JP | 2000299170 | A | 10/2000 |
| JP | 2004-119047 | A | 4/2004 |
| JP | 2008041600 | A | 2/2008 |
| JP | 2008-288116 | A | 11/2008 |
| JP | 2009-252682 | A | 10/2009 |
| WO | 2008127518 | A1 | 10/2008 |

OTHER PUBLICATIONS

European Search Report Application No. 10834426.8-1801/2509170 PCT/JP2010065932; Mar. 25, 2013.

* cited by examiner

*Primary Examiner* — Gary F. Paumen
(74) *Attorney, Agent, or Firm* — Sughrue Mion, PLLC

(57) ABSTRACT

An L-shaped connector, which can waterproof simply and connect an L-shape terminal to an electric shield wire in miniaturized size so as to insulate and electromagnetic shield the L-shaped terminal, includes an L-shaped dividable insulation inner housing receiving an L-shaped terminal joined to the electric shield wire; an electric conductive shield shell covering a terminal receiving portion of the inner housing; an outer housing covering the shield shell; an electric conductive housing receiving a wire lead-out portion of the inner housing, and joining a flange of the shield shell and a flange of the outer housing to a flange of the electric conductive housing by screwing, and connecting a shield portion of the electric shield wire through a shield terminal to the shield shell; and a shield packing waterproofing between the flange of the shield shell and the flange of the electric conductive shell.

4 Claims, 6 Drawing Sheets

L-SHAPED CONNECTOR

CROSS REFERENCE TO RELATED APPLICATIONS

This application is a National Stage of International Application No. PCT/JP2010/065932 filed Sep. 15, 2010, claiming priority based on Japanese Patent Application No. 2009-275295, filed Dec. 3, 2009, the contents of all of which are incorporated herein by reference in their entirety.

TECHNICAL FIELD

This invention relates to an L-shaped connector receiving an L-shaped terminal connected with an electric shield wire so as to perform waterproofing and electro-magnetic shielding.

BACKGROUND ART

FIG. 10 shows one example of an L-shaped connector by prior art (see Patent Document 1).

The L-shaped connector 81 includes an L-shaped male terminal (L-shaped terminal) 82; an electric wire 83 joined to a horizontal portion 82*a* of the male terminal 82; a ferrite member 84 covering a vertical portion 82*b* of the male terminal 82 for reducing noise; a first housing 85 made of insulation resign and receiving the ferrite member 84; a second housing 86 made of insulation resin and covering a top opening 85*a* of the first housing 85; a seal ring 87 inserted at an outside of a end of a vertical portion of the first housing 85 so as to perform waterproofing between a mating connector and itself; a waterproof rubber plug arranged in a frame-shaped horizontal portion 85*b* of the first housing 85 so as to insert the electric wire 83 therethrough.

The first and second housings 85, 86 are adhered and fixed to each other by laser welding from top side thereof so as to waterproof a contact surface 85*a* therebetween. The horizontal portion 85*b* of the first housing 85 is formed into frame-shape. Before assembling the second housing 86 to the first housing 85, the terminal 82 and the electric shield wire 83 having an exposed core wire 83*a* are inserted respectively, and the first and second housings 85, 86 are joined by laser welding from the top side.

Citation List

Patent Document

Patent Document 1: Japan Patent Publication Application No. 2008-288116 (FIG. 2)

SUMMARY OF INVENTION

Objects to be Solved

According to the above usual L-shaped connector 81, the first housing 85 and the second housing 86 should be welded to each other by laser so as to eliminate any gaps therebetween, and also it is difficult to manage to maintain good waterproofing thereof. Special equipment for assembling or disassembling the first and second housing, and welding the L-shaped terminal 82 and the electric wire 83 is required, so that it may lead cost increasing unfortunately. In assembling process, the electric wire 83 must be inserted in the first housing after arranging the L-shaped terminal 82 in the first housing, and must be joined with the L-shaped terminal 82 after that. Thereby, joining the electric wire and the L-shaped terminal is difficult and many operation steps are required. Insulation performance between the ferrite member 84 including ferric oxide and the L-shaped terminal 82 may be reduced unexpectedly. When other method instead of the ferrite member is applied for performing noise reduction (electro-magnetic shielding) and insulation therebetween, a size of the connector may be increased unexpectedly.

According to the above problems, an object of the present invention is to provide an L-shaped connector, which can perform waterproofing easily at low cost, and can join an L-shaped terminal and an electric wire easily and securely, and can perform insulation and electro-magnetic shielding of the L-shaped terminal securely in small size.

How to Attain the Object of the Present Invention

In order to overcome the above problems and attain the object, the present invention according to claim 1 is to provide an L-shaped connector including an L-shaped dividable insulation inner housing receiving an L-shaped terminal joined to an electric shield wire; an electric conductive shield shell covering a terminal receiving portion of the inner housing; an insulation outer housing covering the shield shell; an electric conductive housing, which can insert the electric shield wire therethrough, receiving a wire lead-out portion of the inner housing, and joining a flange of the shield shell and a flange of the outer housing to a flange of the electric conductive housing by screwing, and connecting a shield portion of the electric shield wire through a shield terminal to the shield shell; and a shield packing waterproofing between the flanges of the shield shell and the electric conductive shell.

According to the above structure, the shield packing touches tightly the flanges of the electric conductive housing and the shield shell, so that it is securely prevented that water penetrates into the electric conductive housing, that is a terminal connecting portion of the shield wire and the inner housing. The electric conductive housing and the shield shell are electrically connected for shielding by the flanges of the electric conductive housing and the shield shell. In an assembling process, the electric shield wire is passed (inserted) through the electric conductive housing, and the L-shaped terminal is joined (crimped) to a core wire of the electric shield wire, and the shield terminal is joined to the shield portion (braid) of the electric shield wire. The L-shaped terminal is received into the dividable insulation inner housing under good operating condition and insulated by the insulation inner housing, so that the electric conductive shield shell can be arranged in the vicinity of the L-shaped terminal and thereby the size of the connector can be miniaturized. The L-shaped terminal is covered completely about the full length thereof by the L-shaped inner housing and securely insulated. The outer housing and the shield shell are simply connected and fixed securely to the electric conductive housing by screwing. One electric shield wire can be applied, but plurality of electric shield wires may be applied. Number of the L-shaped terminals and number of the inner housings are changed according to number of the electric shield wires.

The L-shaped connector according to claim 2 is characterized about the L-shaped connector according to claim 1 in that a flange of the inner housing is clamped and fixed through the flange of the electric shield shell between the flange of the electric conductive housing and the flange of the outer housing.

According to the above structure, the flange of the inner housing is pressed and fixed to the flange of the electric conductive housing by the flange of the outer housing. The flange of the electric shield shell is arranged between the flange of the electric conductive housing and the flange of the outer housing, and also between the flange of the inner housing and the flange of the outer housing. A step portion (recess) engaged with the flange of the inner housing may be arranged at the electric conductive housing.

The L-shaped connector according to claim 3 is characterized about the L-shaped connector according to claim 1 or 2 in that the shield packing and a ring-shaped protrusion of the flange of the electric shield shell are engaged with a ring-shaped groove of the flange of the electric conductive housing, and a ring-shaped protrusion of the flange of the outer housing is engaged with a ring-shaped groove arranged at a rear side of the ring-shaped protrusion of the flange of the electric shield shell.

According to the above structure, the thin ring-shaped protrusion of the flange of the shield shell and the thin ring-shaped shield packing are engaged in parallel with the ring-shaped groove of the flange of the electric conductive housing (the ring-shaped protrusion is arranged at an outer area of the ring-shaped groove, and the shield packing is arranged at an inner area of the ring-shaped groove). The ring-shaped protrusion of the outer housing is engaged with an inner space of the ring-shaped protrusion (the ring-shaped groove) of the shield packing, and thereby, the thin ring-shaped protrusion of the shield shell is reinforced (stiffness is increased). The shield packing is pressed tightly to an inner surface of the ring-shaped groove of the electric conductive housing so as to perform higher waterproofing. The ring-shaped protrusion of the shield shell is pressed tightly to an inner surface of the ring-shaped groove of the electric conductive housing by the ring-shaped protrusion of the outer housing so as to perform high connectivity for shielding. The shield packing, the ring-shaped protrusion of the shield shell and the ring-shaped protrusion of the outer housing are engaged in the ring-shaped groove of the electric conductive housing, so that the electric conductive housing, the shield shell and the outer housing are positioned securely along a radial direction.

Effects of the Invention

According to the present invention claimed in claim 1, the terminal connecting portion of the electric shield wire in the electric conductive housing and the L-shaped terminal in the inner housing can be waterproofed securely at a low cost by the shield packing touching tightly the flange of the shield shall and the flange of the electric conductive housing. In the assembling process, by inserting the electric shield wire through the electric conductive housing, the L-shaped terminal and the shield terminal can be simply connected (crimped) securely to the electric shield wire with conventional existing equipment. The L-shaped terminal can be covered completely by the L-shaped inner housing so as to be insulated securely, and thereby the shield shell can be arranged in the vicinity of the L-shaped terminal so as to miniaturize the side and maintain good shield performance.

According to the present invention claimed in claim 2, the inner housing can be simply clamped and fixed securely between the flange of the outer housing and the flange of the electric conductive housing by good operatability.

According to the present invention claimed in claim 3, the shield packing is pressed to the inner surface of the ring-shaped groove of the electric conductive housing by the ring-shaped protrusion of the shield shell, and thereby high waterproofing property can be performed. Additionally, the ring-shaped protrusion of the shield shell is pressed to the inner surface of the ring-shaped groove by the ring-shaped protrusion of the outer housing, and thereby high electric shield connectivity can be performed.

BRIEF DESCRIPTION OF DRAWINGS

FIG. 6 is a perspective view of the aluminum housing which the electric shield wire is inserted through;

DESCRIPTION OF EMBODIMENTS

Figure 1:
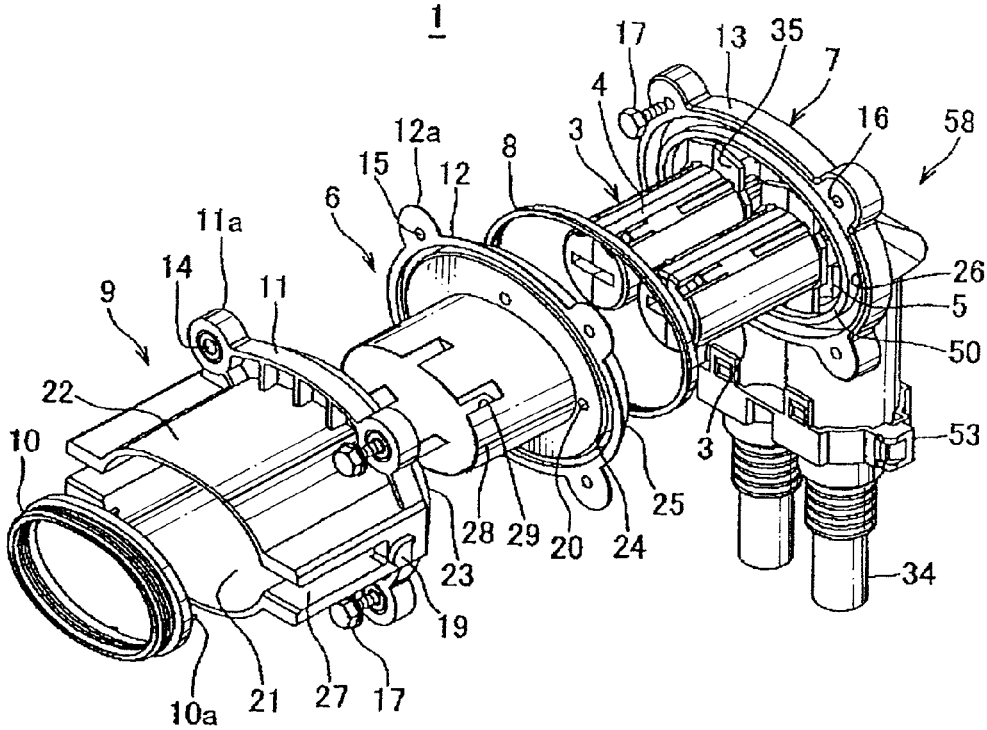
FIG. 1 is an exploded perspective view of an embodiment of an L-shaped connector according to the present invention.

FIG. 1 shows an embodiment of an L-shaped connector according to the present invention.

The L-shaped connector 1 includes an L-shaped inner housing 3 mad of insulation resin and receiving an L-shaped terminal 2 (FIG. 2); a shield shell 6 made of electric conductive metal and covering a horizontal cylindrical portion 4 of the inner housing 3; an aluminum housing 7 (electric conductive housing) made of electric conductive metal and receiving a vertical rectangular cylindrical portion 5 (FIG. 4) of the inner housing 3; a ring-shaped shied packing 8 made of rubber and waterproofing between the shield shell 6 and the aluminum housing 7; an outer housing 9 made of insulation resin and covering the shield shell 6; and a ring-shaped housing packing 10 made of rubber and waterproofing between the shield shell 6 and the outer housing 9.

The outer housing 9 is further called as a front housing. A bolt 17 is inserted through holes 14, 15 of each flange 11, 12 surrounding each of the shield shell 6 and the outer housing 9, and fixed to a female threaded hole 16 of a flange 13 surrounding the aluminum housing 7 outer housing 9, and thereby the outer housing is fixed together with the shield shell to the aluminum housing 7. The aluminum housing 7 can be called as a rear housing corresponding to the front housing 9.

In the embodiment, two inner housings 3 are arranged in parallel at right and left sides in a horizontal direction. The outer housing 9, the flange 13 of the aluminum housing 7 and each of packings 8, 10 are formed into an oval shape having a horizontal major axis in a front view. The outer housing 9 is provided at a right outer side thereof and a left outer sides thereof with a pivot shaft 19 supporting an operating lever 18 (FIG. 7) rotatably for low insertion force. An arrowhead-shaped projection 10*a* at a rear end of the housing packing 10 is inserted and fitted into a hole 20 of the flange 12 of the shield shell 6, and thereby the housing packing 10 is fixed The housing packing 10 is fixed to the shield shell 6. Each of packings 8 and 10 is formed into a plate having a rectangular cross-section.

The outer housing 9 includes a side wall 22 forming a space 21 passing through from a front end toward a rear end thereof, a vertical flange 11 arranged at the rear end of the side wall 22 and a thin oval ring-shaped protrusion 23 projecting from a rear end surface of the flange 11. The ring-shaped protrusion 23 is engaged with a ring-shaped groove 24 arranged near an outer edge of the flange 12 of the shield shell 6. A ring-shaped protrusion 25 having a U-shape cross-section forming the ring-shaped groove 24 (projecting to a rear surface of the ring-shaped groove 24) together with the shield packing 8 is engaged with a ring-shaped groove 26 arranged near to an outer edge of the flange 13 of the aluminum housing 7.

Figure 7:
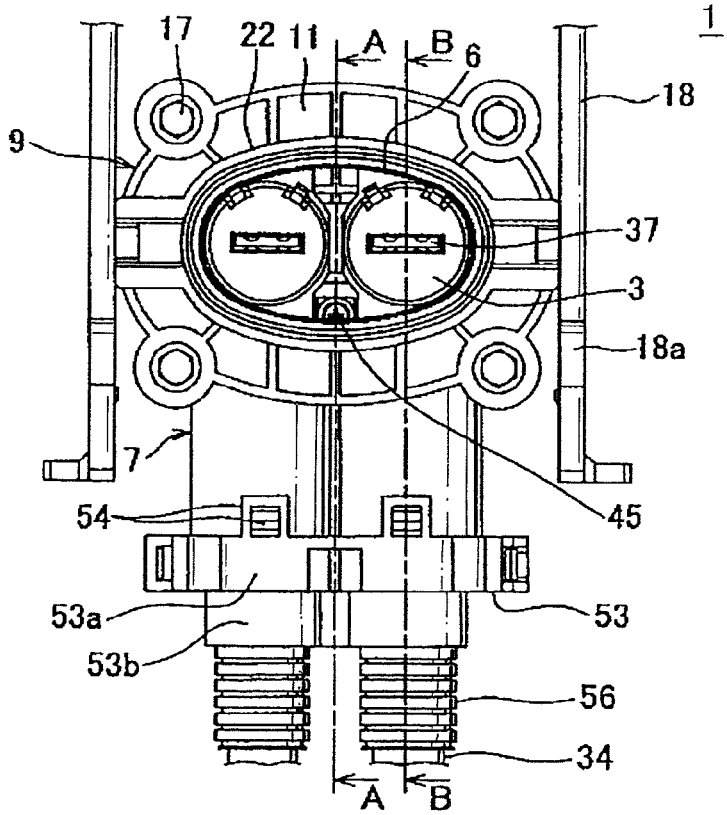
FIG. 7 is a front view of the L-shaped connector assembled completely.

The outer housing 9 is provided with a small flange 11*a* projecting outwardly from the flange 11 and the small flange includes a through hole 14 passing a bolt therethrough. The outer housing 9 is further provided with a horizontal guide slit 27 for a pivot of a mating connector (not shown) engaged with a cam groove 18*a* of the operating lever 18 (FIG. 7).

The shield shell 6 includes a hollow pipe-shaped side wall 28 having an opening at a front end thereof and a rear end thereof, and a vertical flange 12 projecting outwardly in a radial direction from a rear end of the side wall 28. The side wall 28 includes a plurality of slits 29 at a front half area thereof. The flange 12 includes the ring-shaped protrusion 25 projecting from a rear surface thereof and having the U-shaped cross-section to be folded, and a small flange 12*a* projecting outwardly for fixing and having a hole 15 passing a bolt. The ring-shaped protrusion 25 is fitted together with the shield packing 8 into the ring-shaped groove 26 of the aluminum housing 7.

Figure 2:
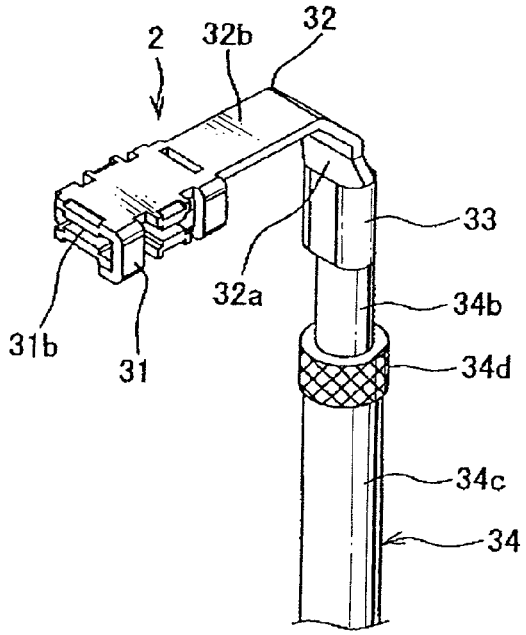
FIG. 2 is a perspective view of an electric shield wire joined with an L-shaped terminal.

FIG. 2 shows an embodiment of the L-shaped terminal 2 joined to the electric shield wire. The L-shaped terminal 2 is a female terminal, and includes a female-type electric contact portion 31, a base plate 32 bent into a L-shape extending from the electric contact portion 31 rearwardly, and a pair of crimp pieces 33 arranged at a vertical portion 32*a* of the base plate 32. The electric contact portion 31 includes a box-shaped portion (call the same marking 31) and an elastic contact piece 31*a* (FIG. 9) arranged inside the box-shaped portion, and a male terminal of the mating connector (not shown) is inserted from a front opening 31*b* and connected. The crimp pieces 33 are crimped with a core portion (conductive core wire) 34*a* of the electric shield wire 34. A braid (shield portion) 34*d* made of electric conductive metal between an inner insulation cover 34*b* and an outer insulation cover 34*c* is folded downwardly. Metal foil instead of the braid 34*d* can be applied.

Figure 3:
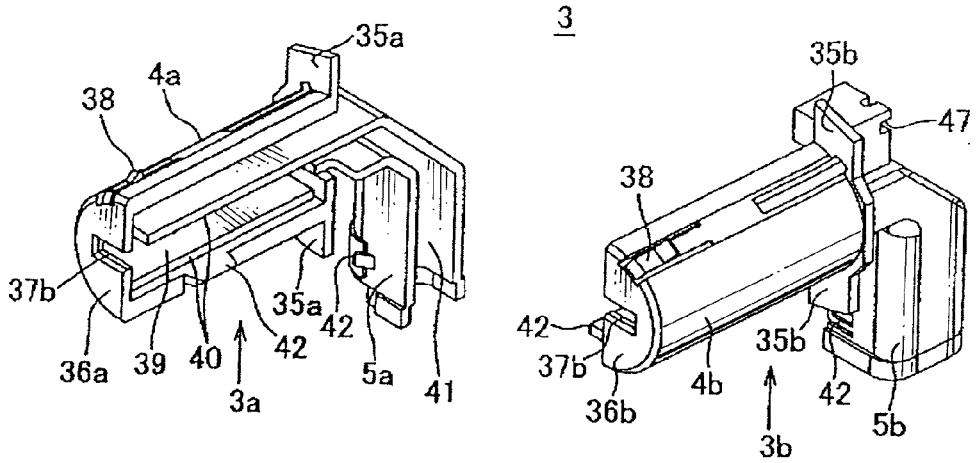
FIG. 3 is an exploded perspective view of an embodiment of an inner housing as a component of the L-shaped connector.

FIG. 3 shows an exploded view of an embodiment of the inner housing 3. The inner housing 3 is formed to be separated to right and left pieces, and each of separated housing 3*a*, 3*b* includes a horizontal half cylindrical portion 4*a*, 4*b*; a rectangular trough-shaped portion 5*a*, 5*b* bent downwardly from a rear end of the half cylindrical portion 4*a*, 4*b*; and a vertical flange 35*a*, 35*b* vertically extending upwardly and downwardly from the rear end of the half cylindrical portion 4*a*, 4*b* and between the half cylindrical portion 4*a*, 4*b* and the rectangular trough-shaped portion 5*a*, 5*b*.

The half cylindrical portion 4*a*, 4*b* includes a circumferential wall (marking 4*a*, 4*b* is marked in substitution) and a front wall 36*a*, 36*b*. The front wall 36*a*, 36*b* includes a male terminal insertion hole 37*b*. The circumferential wall 4*a*, 4*b* is provided at an outside front area thereof with a temporary lock arm 38 for assembling with a cutout slit 29 of the shield shell 6 (FIG. 1), and provided inside the circumferential wall 4*a*, 4*b* with a space 39 partitioned between top and bottom horizontal walls 40 for inserting a horizontal portion of the L-shaped terminal 2 (FIG. 2), that is the electric contact portion 31 and a horizontal portion 32*b* of the base plate 32, from a side area of the space 39 in a horizontal direction.

An inner space 41 of the rectangular trough-shaped portion 5*a*, 5*b* continues to the space 39 of the half cylindrical portion 4*a*, 4*b*. The vertical portion 32*a* of the base plate 32, as a vertical portion of the L-shaped terminal 2, and the pair of crimp pieces 33 together with an end portion of the electric shield wire 34 are received in the inner space 41. The both of the half cylindrical portions 4*a*, 4*b* and the both of the rectangular trough-shaped portions 5*a*, 5*b* are assembled integrally, and each of lock portions (lock claw and lock piece) 42 is locked to each other so as to form the cylindrical portion 4 (terminal receiving portion) and the rectangular cylindrical portion 5 (wire leading portion) shown in FIG. 4.

Figure 4:
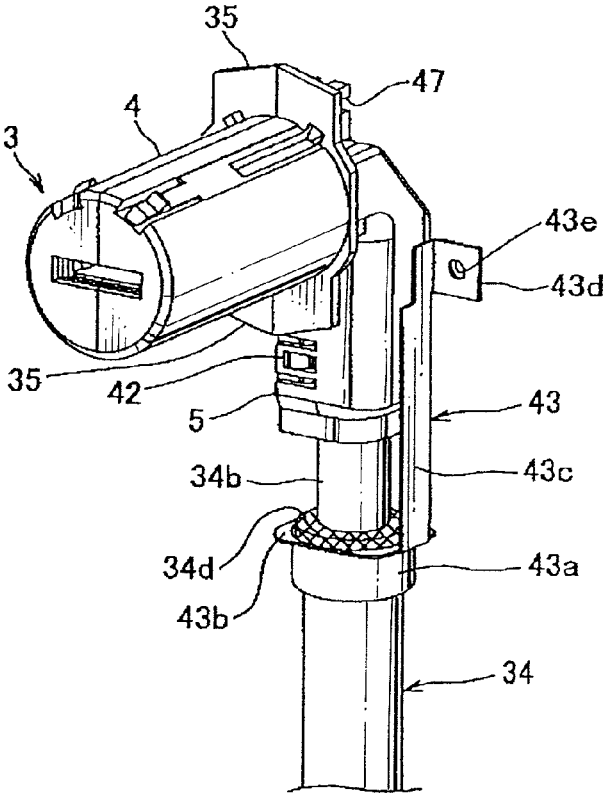
FIG. 4 is a perspective view of an inner housing assembling body configured to arrange the L-shaped terminal at an end of the electric shield wire in the inner housing.

FIG. 4 shows an assembled body of the L-shaped terminal 2 (shown in FIG. 2) joined with the electric shield wire 34 and received in the dividable insulation inner housing 3. Operations of joining the L-shaped terminal 2 to the electric shield wire 34 and assembling the L-shaped terminal 2 into the inner housing 3 are acted after inserting the electric shield wire 34 through the later-described aluminum housing 7.

As shown in FIG. 4, the L-shaped terminal 2 and the end portion of the electric shield wire 34 continued from the L-shaped terminal 2 are completely covered by the L-shaped inner housing 3 so as to be securely insulated from outside. The inner insulation cover 34*b* of the electric shield wire 34 is led from a bottom end of the vertical rectangular cylindrical portion 5 of the inner housing 3. A shield terminal 43 made of electric conductive metal is joined to the braid 34*d* of the electric shield wire 34.

The shield terminal 43 is formed by a ring-shaped portion 43*a* to be connected with the braid 34*d* over an electric conductive sleeve 44 (FIG. 6); a long narrow plate 43*c* extending vertically from a side end of a flange 43*b* at a top end of the ring-shaped portion 43*a* in parallel to the inner insulation cover 34*b* of the electric shield wire 34; and a vertical connection fixing piece 43*d* bent in a direction of 90° angle at an end portion of the plate 43*c*. The fixing portion 43*d* includes a hole 43*e* for inserting a vis 45 about the aluminum housing 7 (FIG. 1).

The inner housing 3 in FIG. 4 is located at a left side in the aluminum housing 7 shown in FIG. 1. The inner housing 3 as same as the inner housing 3 at the left side is used at a right side. The shield terminal 43 as same as the shield terminal 43 shown in FIG. 4 is used for the electric shield wire 34 at the right side so as to be located symmetrically by turning back to front. The fixing pieces 43*d* of the both of shield terminals 43 are overlapped to each other in front and behind and fixed at the aluminum housing 7 by the vis 45 (FIG. 7) for connecting. In FIG. 4, the vertically extending flange 35 of the inner housing; the lock portion 42; and a positioning groove 47 of the inner housing 3 corresponding to a rib 46 (FIG. 5) of the aluminum housing 7 are shown.

Figure 5A:
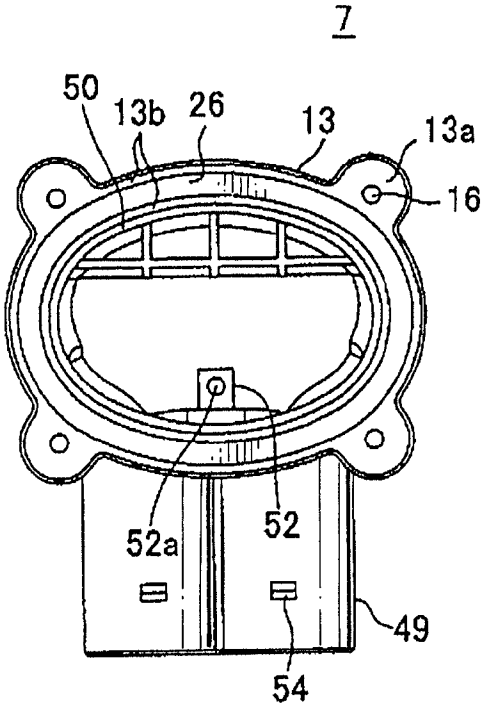
FIG. 5A is a front view of an aluminum housing as a component of the L-shaped connector.
Figure 5B:
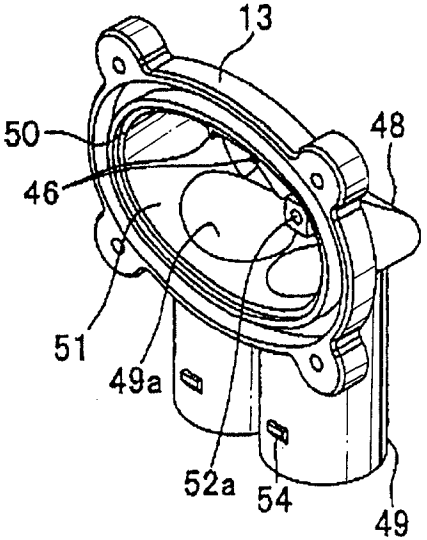
FIG. 5B is a perspective view of the aluminum housing.
Figure 5C:
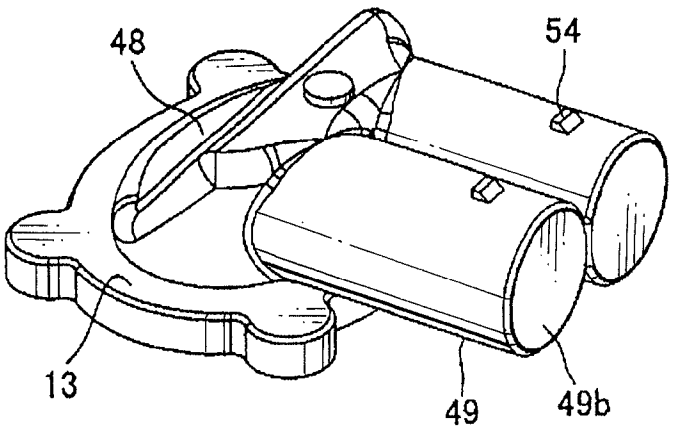
FIG. 5C is a perspective rear view of the aluminum housing.

FIGS. 5A-5C show each of views from different angles of the one embodiment of the aluminum housing 7 (electric conductive housing). The aluminum housing 7 includes the elliptical ring-shaped flange 13 (flange), a projecting wall 48 continued to a rear portion of the flange 13 and having an arm-shaped cross-section, and a pair of cylindrical portions 49 projecting downwardly from the projecting wall 48 at right and left sides and formed integrally.

The flange 13 includes the ring-shaped groove 26 arranged at a front end surface 13*b*, a step portion 50 recessed inwardly by one step from the front end surface 13*b* and a small flange 13*a* at an outer side thereof. The small flange 13*a* includes a female thread hole 16. The vertical flange 35 of the inner housing 3 shown in FIG. 4 abuts on a front surface of the step portion 50 at top and bottom portions of the front surface. The flange 35 is clamped and fixed through the flange 12 of the shield shall between the flange 11 of the outer housing 9 and the step portion 50.

An inner space 51 of the flange 13 communicates to an inner space of the projecting wall 48, and the inner space of the projecting wall 48 through a top opening 49*a* of each cylindrical portion 49 to a bottom opening 49*b* thereof. A projection 52 and a female thread hole 52*a* for fixing the shield terminal 43 (FIG. 4) are provided at an inner surface of the projecting wall 48. At bottom area of a front side and a rear side of the cylindrical portion 49, lock projections 54 corresponding to a wire holder 53 in FIG. 7 are arranged.

Figure 6:
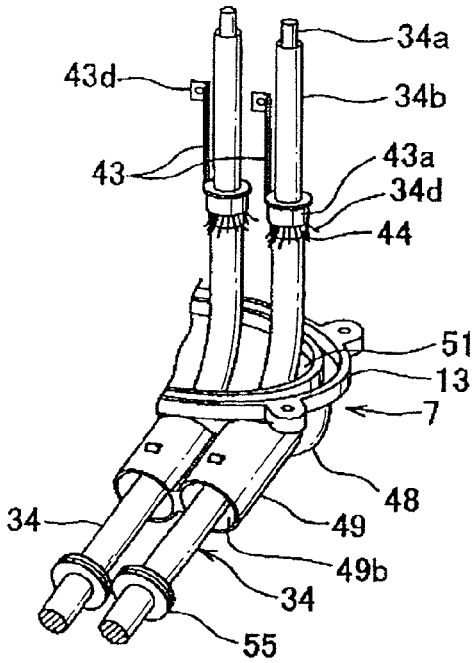

FIG. 6 shows a condition that each electric shield wire 34 is inserted through the aluminum housing 7 and the electric shield wire 34 is presently joined to the shield terminal 43 (the condition is before the electric shield wire is joined). Previously (before inserting the electric shield wire 34 through the aluminum housing 7), the electric shield wire 34 is inserted to a waterproofing rubber plug 55 and the electric conductive sleeve 44 from the end portion of the electric shield wire 34 (inserted and arranged around the electric shield wire 34). Thereafter, the end portion of the electric shield wire 34 is peeled so as to expose the conductive core wire 34*a* and the braid 34*d*. The braid 34*d* is folded over the electric conductive sleeve 44 (operation of folding the braid 34*d* may be acted after inserting the electric shield wire 34 through the aluminum housing 7).

The electric shield wire 34, to which the shield terminal 43 is not yet attached, is led from the bottom opening 49*b* of the cylindrical portion 49 of the aluminum housing 7 through the space 51 inside the flange 13 forwardly (toward outside). At the above condition, the ring-shaped portion 43*a* of the shield terminal 43 is pressed on the braid 34*d* over the electric conductive sleeve 44 and joined with it. Thereafter, the L-shaped terminal 2 (FIG. 2) is joined by crimping to the conductive core wire 34*a* by a not-shown crimping apparatus. The L-shaped terminal 2 can be joined before the shield terminal 43 is joined. According to the structure, the shield terminal 43 and the L-shaped terminal 2 can be joined and fixed easily and securely to the electric shield wire 34 by general equipment in low cost.

Figure 8:
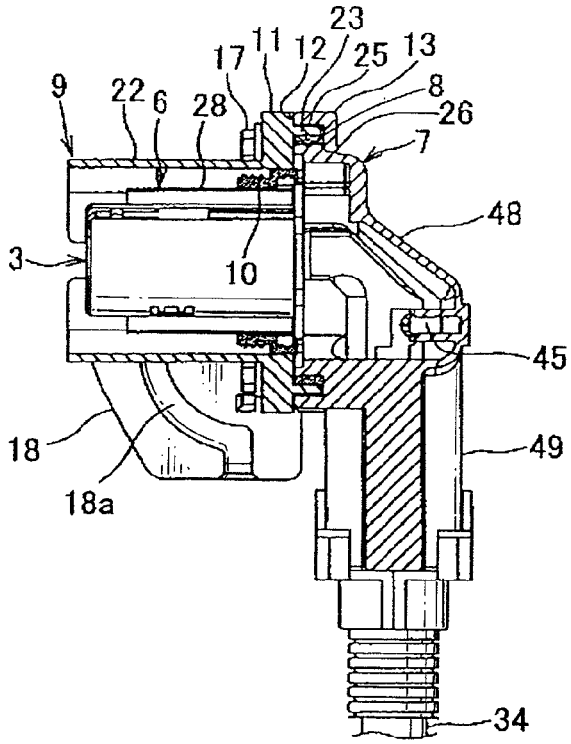
FIG. 8 is a cross-sectional view taken along the line A-A shown in FIG. 7.
Figure 9:
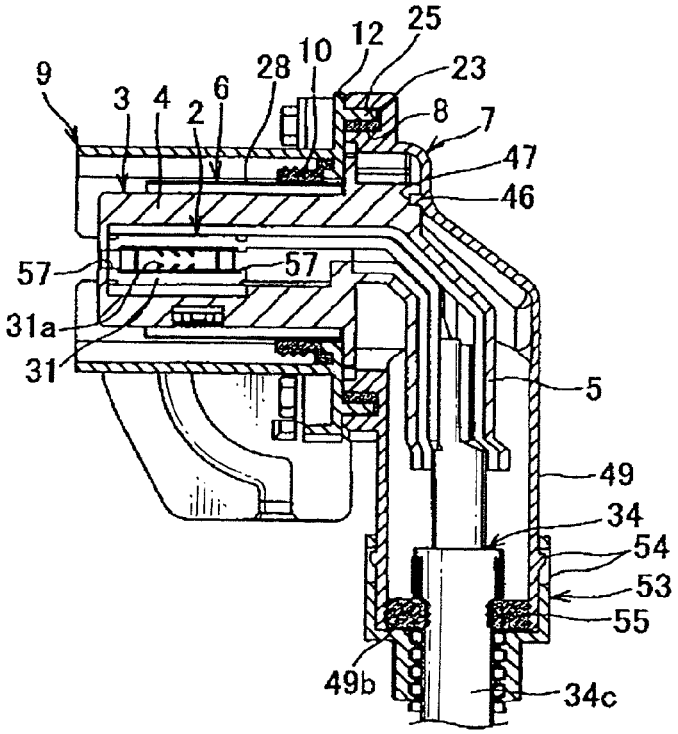
FIG. 9 is a cross-sectional view taken along the line B-B shown in FIG. 7.
Figure 10:
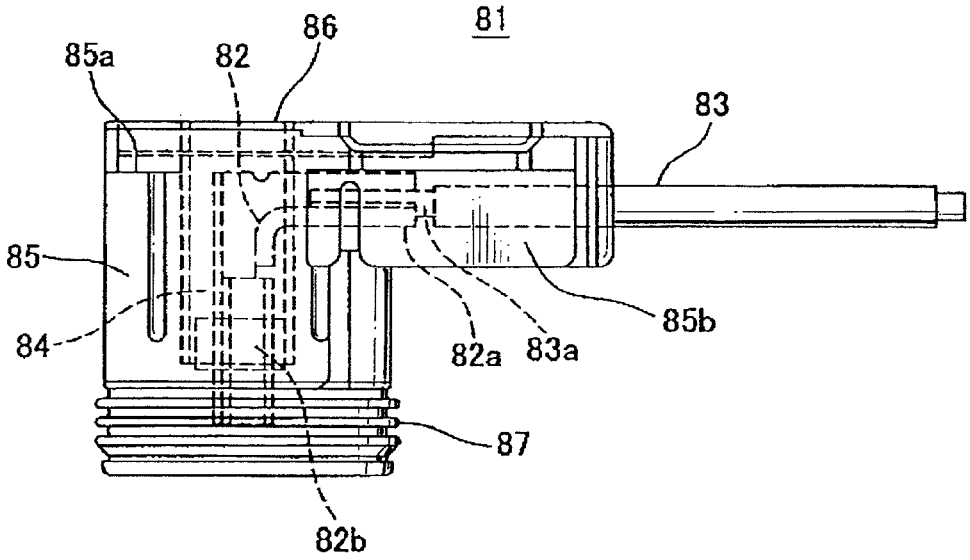
FIG. 10 PRIOR ART
FIG. 10 is a side view of an embodiment of an L-shaped connector by prior art.

FIG. 7 is a front view showing the assembled L-shaped connector 1. FIG. 8 is a cross-sectional view taken along the line A-A shown in FIG. 7. FIG. 9 is a cross-sectional view taken along the line B-B shown in FIG. 7.

As shown in FIGS. 7 and 8, the shield terminal 43 shown in FIG. 6 is joined to the aluminum housing 7 by screwing the vis 45 (male thread member). The braid 34*d* of the electric shield wire 34 is connected through the shield terminal 43 to the aluminum housing 7. As shown in FIG. 9, the waterproofing rubber plug 55 shown in FIG. 6 is fitted in the bottom opening 49*b* of the cylindrical portion 49 of the aluminum housing 7. The vis 45 (FIG. 7) is screwed easily and securely before the shield shell 6 is assembled to the aluminum housing 7. The end portion (the braid 34*d* and the conductive core wire 34*a*) of the electric shield wire 34 and the vertical portion (the crimping pieces 33) of the L-shaped terminal 2 in the inner housing 3 are covered by the aluminum housing 3 so as to be electrically shielded.

The side wall 28 of the shield shell 6 is arranged around the outside of the cylindrical portion 4 in the vicinity of the rectangular cylindrical portion 4 of the inner housing 3 covering the electric contact portion 31 of the L-shaped terminal 2. The flange 12 of the shield shell 6 is joined and fixed to the aluminum housing 7 by screwing the bolt 17. Thereby, the ring-shaped protrusion 25 having a U-shaped cross-section of the flange 12 abuts on the outer inner surface of the ring-shaped groove 26 of the aluminum housing 7, and the shield packing 8 abuts tightly on an inside inner surface of the ring-shaped groove 26 and an inner surface of the ring-shaped protrusion 25, and the ring-shaped protrusion 23 of the outer housing 9 is engaged into the ring-shaped protrusion 25 (ring-shaped groove 24) so as to make the ring-shaped protrusion 25 touch tightly the ring-shaped groove 26 of the aluminum housing 7 and the shield packing 8, so that shielding and waterproofing can be securely acted.

The L-shaped terminal 2 is covered completely about the full length thereof by the L-shaped inner housing 3 and securely insulated, so that the shield shell and the aluminum housing 7 can be located in the vicinity of the L-shaped terminal 2. Thereby, extra room in the connector 1 can be eliminated and the size of the connector can be miniaturized.

The housing packing 10 contacts tightly between an outer surface of the side wall 28 and an inner surface of the side wall 22 of the outer housing 9 so as to prevent that water drop penetrates through a gap between an outer surface of a mating connector housing (not shown) and the inner surface of the outer housing 9 into the L-shaped connector 1. An inner surface of the mating connector housing touches tightly to the outer surface of the housing packing 10.

As shown in FIG. 9, an outer surface of the waterproofing rubber plug 55 touches tightly to an inner surface of the cylindrical portion 49 of the aluminum housing 7, and an inner surface of the waterproofing rubber plug 55 touches tightly to an outer surface of the outer insulation cover 34*c* of the electric shield wire 34, so that it can be prevented that water penetrates from the bottom of the cylindrical portion 49 into the cylindrical portion 49. A wire holder 53 made of synthetic resin is arranged at a bottom end portion of the cylindrical portion 49 and locked by lock portions 54 (lock projection and lock frame). As shown in FIG. 7, the wire holder 53 includes a ring-shaped portion 53*a* covering the pair of cylindrical portions 49 and a pair of tube portions 53*b* projecting downwardly from the ring-shaped portion 53*a*. A bellows-shaped wire protecting tube 56 is arranged and fixed in an inner surface of each of tube portions 53*b*.

General waterproof components, such the shield packing 8, the housing packing 10 and the waterproofing rubber plug 55, are used, so that waterproofing can be acted securely in low cost. The shield packing 8, the ring-shaped protrusion 25 of the shield shell 6 and the ring-shaped protrusion 23 of the outer housing 9 are received at the same time into the ring-shaped groove 26 at the front end of the flange 13 of the aluminum housing 7. Thereby, the size of the structure thereof can be miniaturized and each of components (the aluminum housing 7, the shield shell 6 and the outer housing 9) can be positioned more securely.

The inner housing 3 is positioned by engaging each of the grooves 47 at the rear end of the inner housing 3 with a pair of right and left ribs 46 (protrusions) and fixed by clamping the flange 35 (FIG. 4) nearer to the front side thereof through the flange 12 of the shield shell 6 between the flange 11 of the outer housing 9 and the inner step portion 50 (FIG. 5) of the flange 13 of the aluminum housing 7. The inner housing 3 is not fixed by the bolt, so that operations for fixing can be eliminated and efficiency of the operation for assembling can be improved.

In FIGS. 7-9, the operating lever 18 for low insertion force is shown, and in FIG. 9, the vertical rectangular cylindrical portion 5 of the inner housing 3 is shown. As shown in FIG. 9, the electric contact portion 31 of the L-shaped terminal 2 is positioned by front and rear protrusions 57 in the cylindrical portion 4, and elastic contact pieces 31*a* are shown in the electric contact portion 31.

As shown in FIG. 6, the electric shield wire 34 is inserted through the aluminum housing 7, and the L-shaped terminal 2 and the shield terminal 43 are joined to the electric shield wire 34. As shown in FIG. 4, the L-shaped terminal 2 is assembled in the inner housing 3, and as shown in FIG. 1, an assembled body 58 is built with the aluminum housing 7, the electric shield wire 34 and the inner housing 3. Thereafter, the shield packing 8 is attached to the ring-shaped groove 26 of the aluminum housing 7. The shield shell 6 having the housing packing 10 is assembled so as to slide along the cylindrical portion 4 of the inner housing 3. After that, the outer housing 9 is assembled over the shield shell 6, so that the L-shaped connector 1 is completely assembled.

In the above embodiment, the inner housing 3 is designed dividable to be right and left portions. Instead, the inner housing 3 can be dividable to be upper and lower portions. Number of the inner housings 3 is not limited to a pair, but three inner housings 3 can be arranged in parallel. In this case, number of the electric shield wires 3 is three, so that three cylindrical portions 49 of the aluminum housing 7 are formed in parallel.

Applicability of Invention

The L-shaped connector according to the present invention can be applicable for electrically connecting to a connector arranged directly at an apparatus and a connector of a wiring harness in an electric car including a hybrid car with high waterproofing and good electric shielding in a miniaturized space.

Remarks

1 L-shaped connector
2 L-shaped terminal
3 Inner housing
4 Cylindrical portion
5 Rectangular cylindrical portion
6 Shield shell
7 Aluminum housing
8 Shield packing
9 Outer housing
11, 12, 13 Flange
16 Female thread hole
17 Bolt
23, 25 Ring-shaped protrusion
24, 26 Ring-shaped groove
34 Electric shield wire
34*d* Braid (shield portion)
35 Flange
43 Shield terminal

The invention claimed is:

1. An L-shaped connector, comprising:

an L-shaped dividable insulation inner housing receiving an L-shaped terminal joined to an electric shield wire;

an electric conductive shield shell covering a terminal receiving portion of the inner housing;

an insulation outer housing covering the shield shell;

an electric conductive housing, which can insert the electric shield wire therethrough, receiving a wire lead-out portion of the inner housing, and joining a flange of the shield shell and a flange of the outer housing to a flange of the electric conductive housing by screwing, and connecting a shield portion of the electric shield wire through a shield terminal to the shield shell; and a shield packing waterproofing between the flange of the shield shell and the flange of the electric conductive housing.

2. The L-shaped connector according to claim 1, wherein a flange of the inner housing is clamped and fixed through the flange of the electric shield shell between the flange of the electric conductive housing and the flange of the outer housing.

3. The L-shaped connector according to claim 1, wherein the shield packing and a ring-shaped protrusion of the flange of the electric shield shell are engaged with a ring-shaped groove of the flange of the electric conductive housing, and a ring-shaped protrusion of the flange of the outer housing is engaged with a ring-shaped groove arranged at a rear side of the ring-shaped protrusion of the flange of the electric shield.

4. The L-shaped connector according to claim 2, wherein the shield packing and a ring-shaped protrusion of the flange of the electric shield shell are engaged with a ring-shaped groove of the flange of the electric conductive housing, and a ring-shaped protrusion of the flange of the outer housing is engaged with a ring-shaped groove arranged at a rear side of the ring-shaped protrusion of the flange of the electric shield.

* * * * *